US007823935B2

(12) United States Patent
Norris et al.

(10) Patent No.: US 7,823,935 B2
(45) Date of Patent: Nov. 2, 2010

(54) LOCKING SYSTEM FOR WINDOWS AND DOORS

(75) Inventors: Jeffrey Norris, Windham, CT (US); Nathanael Lee, Essex, CT (US); Christopher Griffin, Groton, CT (US)

(73) Assignee: Roto Frank of America, Inc., Chester, CT (US)

( * ) Notice: Subject to any disclaimer, the term of this patent is extended or adjusted under 35 U.S.C. 154(b) by 427 days.

(21) Appl. No.: 11/735,551

(22) Filed: Apr. 16, 2007

(65) Prior Publication Data

US 2008/0250719 A1 Oct. 16, 2008

(51) Int. Cl.
*E05C 1/12* (2006.01)
*E05C 9/10* (2006.01)

(52) U.S. Cl. ..... 292/161; 292/40; 292/DIG. 20

(58) Field of Classification Search ..... 292/26, 292/29, 30, 35, 36, 38, 40, 41, 42, 139, 141, 292/143, 145, 150, 156, 158, 161, DIG. 20
See application file for complete search history.

(56) References Cited

U.S. PATENT DOCUMENTS

| | | | | | |
|---|---|---|---|---|---|
| 718,101 | A | * | 1/1903 | Decker | 292/161 |
| 4,803,808 | A | * | 2/1989 | Greisner | 49/394 |
| 4,991,886 | A | | 2/1991 | Nolte et al. | |
| 4,998,757 | A | * | 3/1991 | Ramsauer | 292/39 |
| 5,039,143 | A | * | 8/1991 | Ramsauer | 292/39 |
| 5,087,087 | A | * | 2/1992 | Vetter et al. | 292/48 |
| 5,118,145 | A | * | 6/1992 | Tucker | 292/158 |
| 5,370,428 | A | * | 12/1994 | Dreifert et al. | 292/161 |
| RE35,463 | E | * | 2/1997 | Vetter et al. | 292/48 |
| 5,741,031 | A | * | 4/1998 | Bauman et al. | 292/139 |
| 5,813,710 | A | | 9/1998 | Anderson | |
| 5,887,915 | A | * | 3/1999 | Ramsauer | 292/160 |
| 5,927,767 | A | * | 7/1999 | Smith et al. | 292/158 |
| 6,109,668 | A | * | 8/2000 | Demarco | 292/161 |
| 6,135,511 | A | * | 10/2000 | Smith et al. | 292/156 |
| 6,230,457 | B1 | | 5/2001 | Brautigam | |
| 6,354,639 | B1 | | 3/2002 | Minter et al. | |
| 6,367,853 | B1 | | 4/2002 | Briggs | |
| 6,425,611 | B1 | | 7/2002 | Minter et al. | |
| 6,651,389 | B2 | | 11/2003 | Minter et al. | |
| 6,672,010 | B1 | | 1/2004 | Gledhill et al. | |
| 6,698,970 | B2 | * | 3/2004 | Guillemet et al. | 403/373 |
| 7,040,672 | B1 | * | 5/2006 | Runge et al. | 292/42 |
| 7,396,054 | B2 | * | 7/2008 | Carrier | 292/75 |

* cited by examiner

*Primary Examiner*—Carlos Lugo
*Assistant Examiner*—Alyson M Merlino
(74) *Attorney, Agent, or Firm*—Miller, Matthias & Hull

(57) ABSTRACT

A lock system for casement windows is disclosed which includes a tie bar slidably secured to the flame. The tie bat is secured to a lock handle that is also secured to the flame. The tie bat eliminates the need for rollers riveted to the tie bar by having a first bent section disposed between straight sections and a second bent section disposed between straight sections. All of the straight sections are linearly aligned with one another and at least some of the straight sections of the tie bar are slidably mounted to the flame using conventional guides. The lock system also includes first and second strikers mounted to the sash. The first striker comprising a first ramp that receives a first bent section and the second striker comprising a second ramp that receives a second bent section when the tie bat is slidably moved towards the first and second strikers as the tie bar is moved from an unlocked position to a locked position. Movement of the first and second bent sections along the first and second ramps respectively as the tie bar moves towards the locked position results in the sash and frame being pulled together. A third bent section may be included towards the middle of the tie bar and used to couple the tie bar to the lock handle or actuator.

6 Claims, 12 Drawing Sheets

30
31
39a
32
49
44
38
45'
45
45'
43
48
48
49
36
45
43
45
148
34
51
45'
37

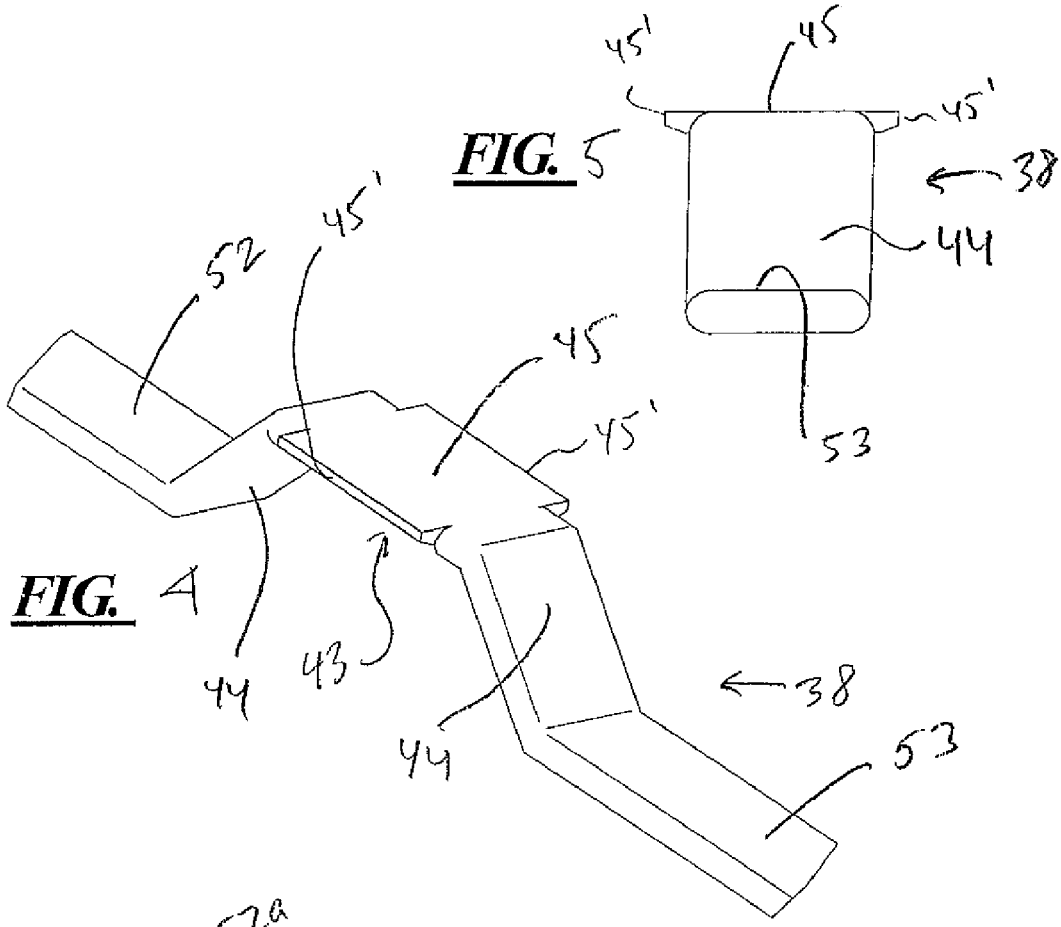
FIG. 5
FIG. 4
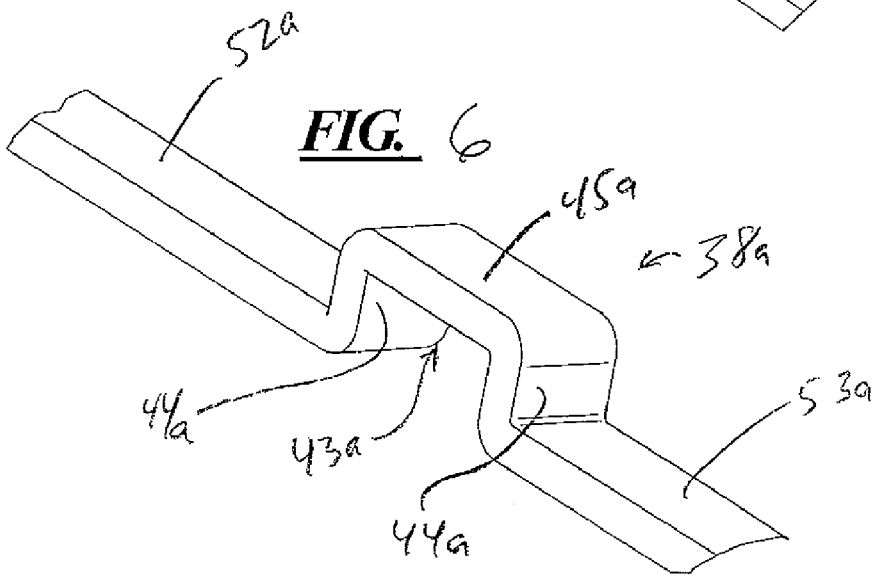
FIG. 6

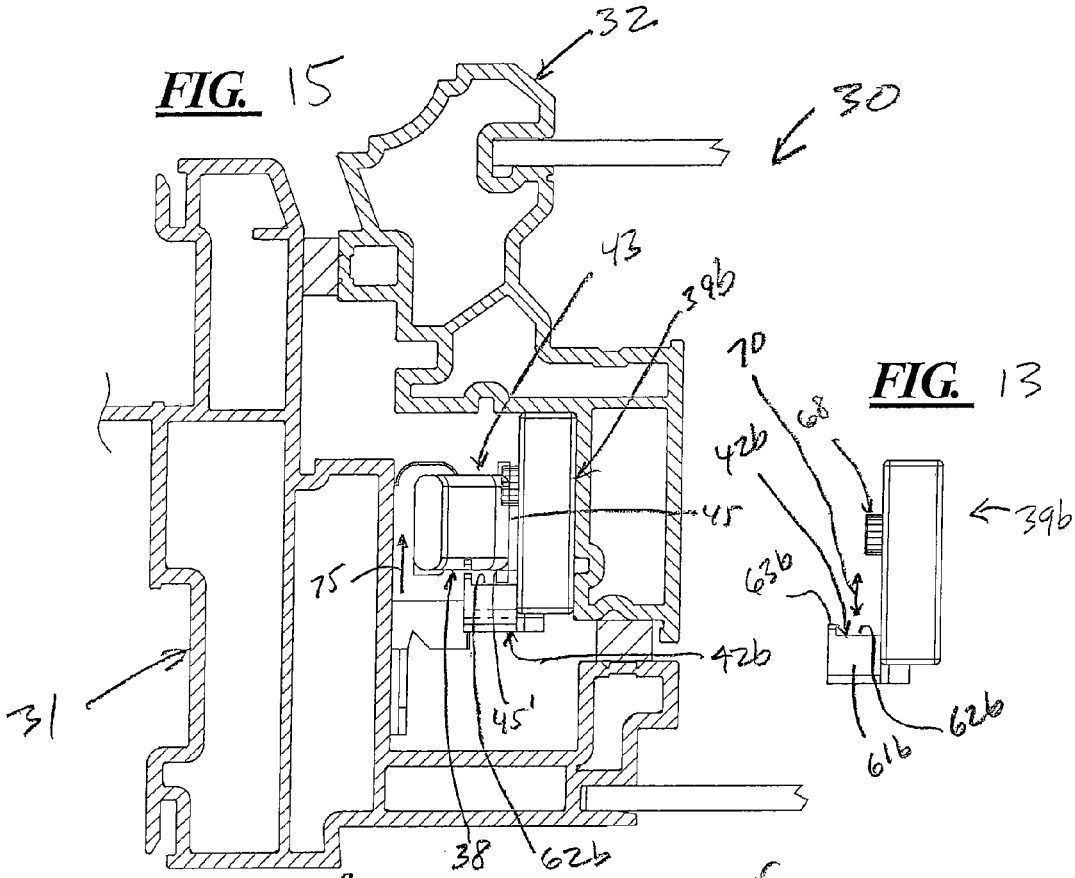
FIG. 15
32
30
43
39b
45
75
42b
45'
38
62b
31
FIG. 13
70
68
42b
39b
63b
62b
61b
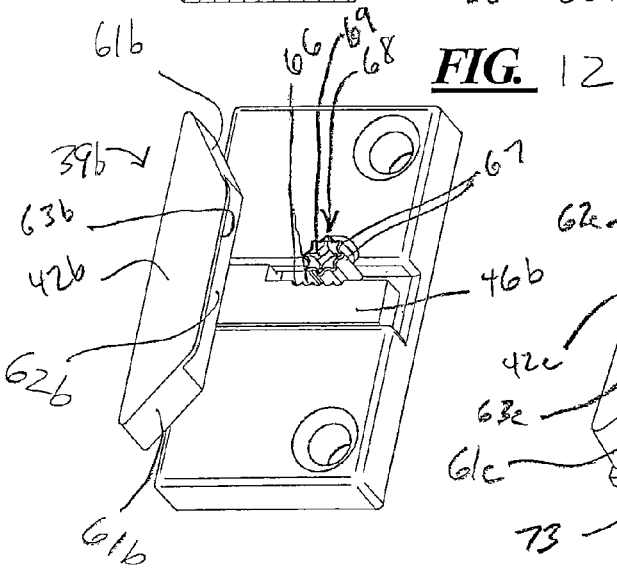
FIG. 12
61b
66
69
68
39b
67
63b
42b
46b
62b
61b
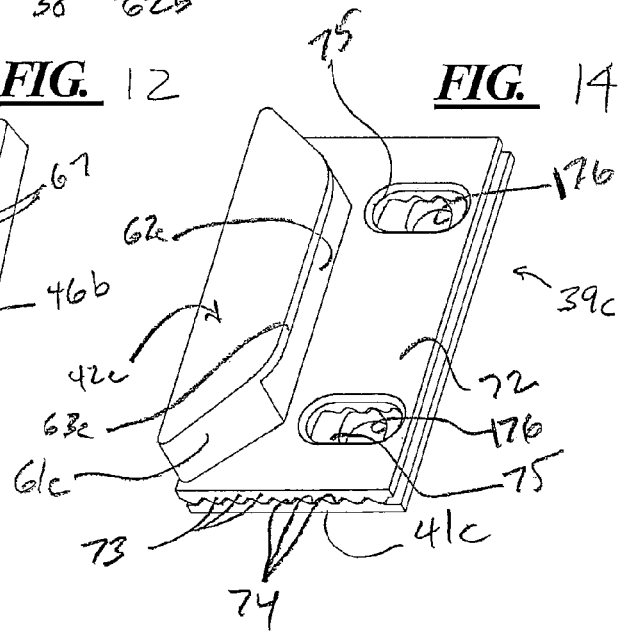
FIG. 14
75
176
62c
39c
42c
72
63c
176
61c
75
73
41c
74

FIG. 22
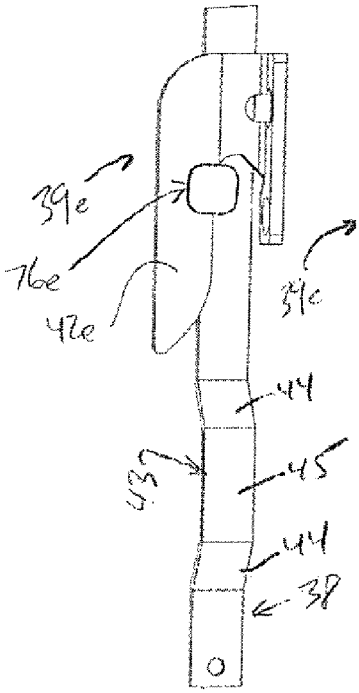
FIG. 23
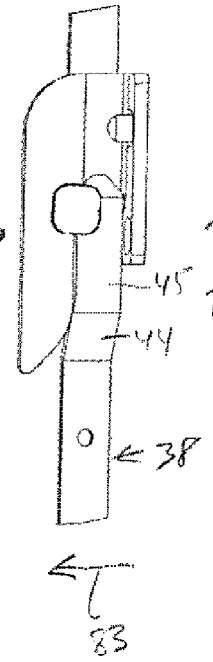
FIG. 24
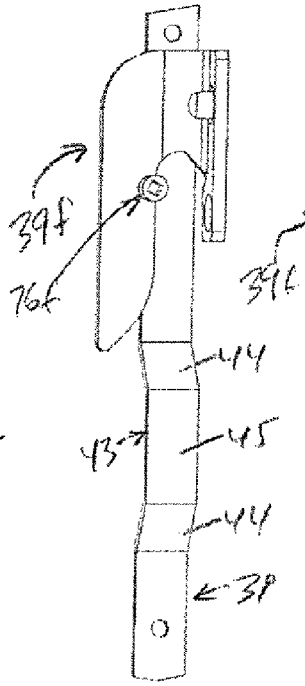
FIG. 25
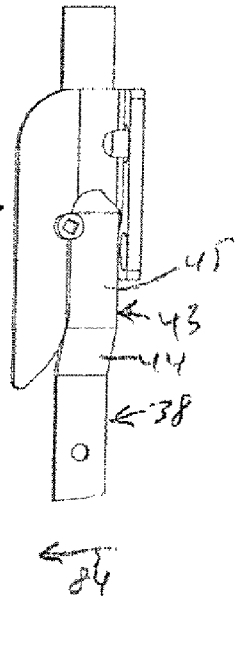
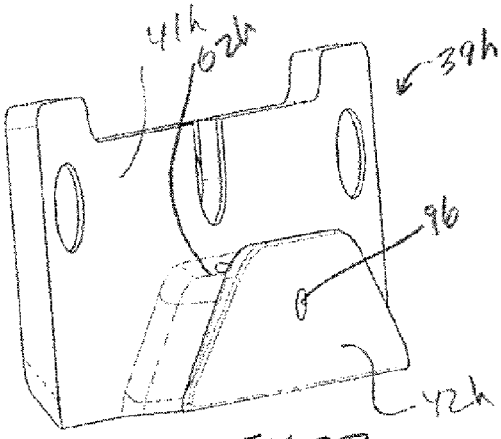
FIG 27
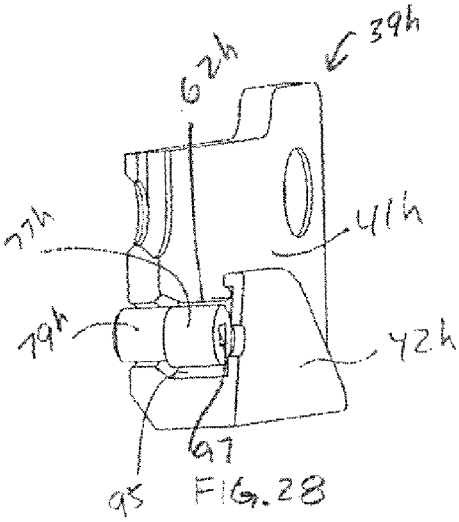
FIG. 28

LOCKING SYSTEM FOR WINDOWS AND DOORS

BACKGROUND

1. Technical Field

A locking system for windows and doors is disclosed which includes an otherwise straight tie bar with one or more bent sections therein for engaging strikers fixedly mounted to the window sash or door. An additional bent section may be provided near or at the middle of the bar for purposes of coupling the bar to a lock handle. Adjustable strikers are also disclosed that may be used with the disclosed tie bars.

2. Description of the Related Art

Casement windows are known. In the past, the locking of a casement window sash to a window frame has been problematic because casement window sashes have a tendency to warp with age and therefore it can be difficult to hold an entire side edge of a sash against a frame for locking purposes. Further, casement window operators typically apply the closing force to only one end of the casement window sash, e.g., the bottom end, and therefore there is a tendency for one end of the sash to engage the frame before the opposing end of the sash As a result, the entire side edge of the sash that is to be locked against the frame does not simultaneously engage the flame all at once thereby making the sash difficult to lock.

To overcome these problems, tie bars have been employed along the edge of the frame to lock the sash against the frame. The tie bars typically include a plurality of rollers riveted onto the tie bar that engage tamped keepers spaced along the edge of the window sash. To address the warping problem discussed above, the rollers and keepers are appropriately spaced so that the rollers engage the keepers in a sequential manner, typically starting from the bottom of the sash and ending with the top of the sash. As a result, the bottom of the sash is locked first and the sequential interaction of the middle and top rollers with the middle and top keepers respectively results in the middle and top portions of the sash being pulled against the frame and locked shut.

With the above-described sequential locking systems, proper alignment of each roller with its respective striker is imperative for facilitating the proper locking sequence with the least amount of force necessary. Because in most systems the position of the roller on the tie bar is fixed by way of the rivet connection, adjustments of the position of either the tie bar or the strikers is necessary to facilitate the locking sequence U.S. Pat. No. 6,651,389, commonly assigned with the present application, discloses a roller connected to a tie bar with an eccentrically disposed pin that enables the relative position of the roller with respect to the tie bar (and therefore this protector) to be adjusted once the tie bar is installed.

However, the roller/tie bar connection disclosed in the '389 patent is expensive from a manufacturing standpoint. At least two parts are required in addition to the tie bar—the rivet or pin and the roller—and the eccentric rivet must be secured to both the roller in the tie bar in a relatively time-consuming riveting operation. More conventional designs require the roller to be riveted to the tie bar, which also requires two parts—the rivet and the roller in addition to the tie bar. As manufacturers face increasing pressure from a cost standpoint, there is a need for eliminating additional parts and therefore there is a need for an improved means for engaging a tie bar with a striker with fewer parts.

Finally, the position of the strikers with respect to the tie bar/rollers is critical if the window lock is to be moved from the unlocked to the locked position with as little force as possible. Hence, some sort of minor adjustment of the position of the striker with respect to the tie bar/roller would be advantageous, particularly if such an adjustment could be made after installation of the striker and tie bar.

SUMMARY OF THE DISCLOSURE

In satisfaction of the aforenoted needs, improved lock assemblies are disclosed for securing a window frame to a window sash.

One improved lock assembly comprises a tie bar coupled to a lock handle. The tie bar comprises a first bent section disposed between straight sections. The straight sections are linearly aligned with one another. The lock assembly further comprises at least one striker. The straight sections are slidably mounted to one of the window sash or window frame and the least one striker is mounted to the other of the window sash or window flame. In the conventional and currently preferred embodiment the lock handle and tie bar are mounted to the stationary window frame and the complementary striker(s) is mounted on the pivoting window sash. The first striker comprises a first ramp that receives the first bent section and when the tie bar slides towards the first striker as the tie bar and lock handle out moved from an unlocked position to a locked position. The movement of the first bent section of the tie bar along the first ramp of the striker as the tie bar moves towards the locked position results in the window sash and window frame being pulled together.

In a refinement, the tie bar of the lock assembly further comprises a second bent section disposed between straight sections and the lock assembly comprises a second striker. Like the first striker, the second striker comprises a second ramp that receives the second bent section and when the tie bar slides towards the second striker as the tie bar and lock handle are moved from the unlocked position to the locked position. Like the relationship between the first bent section and the first striker, the movement of the second bent section along the second ramp as the tie bar moves towards the locked position results in the window sash and window frame being pulled together.

In another refinement, the tie bar of the lock assembly comprises a third bent section disposed between straight sections and between the first and second bent sections, the third bent section being coupled to the handle.

It will be noted that the number of sections in each bar may vary greatly and the number can range from one to eight or more. Further, it will be noted that the lock handle may be coupled to any bend in the tie bar or the lock handle can be coupled to the tie bat by way of a link, rivet, pin or other attachment or coupling mechanism.

In another refinement, the bent section(s) of the tie bat is rectangular-shaped and comprises two opposing end walls connected to and extending perpendicularly from the straight sections. The first bent section also comprises a flat middle section that connects the end walls and which is disposed parallel to the straight sections.

In another refinement, the bent section(s) of the tie bar is trapezoidal-shaped and comprises two opposing end walls connected to and extending obtusely from the straight sections toward each other and toward a flat middle section that connects the end walls and which is disposed parallel to the straight sections.

In another refinement, the bent section are accurate as they extend from one straight section to the other straight section.

In another refinement, the bent section(s) is triangular-shaped and comprises two opposing end walls connected to and extending obtusely from the straight sections toward each other before being connected together at an acute angle.

It will be noted that a variety of different shapes for the bend(s) in the tie bars are available and the limited number of shapes disclosed herein may be expanded upon as will be apparent to those skilled in the art.

In another refinement, the flat middle section of the bent section(s) is wider than the end walls of the bent section(s). In other words, the flat middle section is stamped, coined or pressed so that it has flanged edges to assist in engaging and maintaining engagement with the striker.

In another refinement, the flat middle section of the bent section(s) is wider than the straight sections disposed on either side of the bent section(s).

It will be noted that the stamped or pressed middle section with flanged outer edges can be employed with any of the bend geometries.

In another refinement, the lock assembly comprises a tie bar coupled to a lock handle. The tie bar comprises a first bent section disposed between straight sections and a second bent section disposed between straight sections. All of the straight sections are linearly aligned with one another. Further, at least some of the straight sections of the tie bar are slidably mounted to the window frame. The lock assembly further comprises first and second strikers mounted to the window sash. The first striker comprising a first ramp that receives a first bent section and the second striker comprising a second ramp that receives a second bent section when the tie bar is slidably moved towards the first and second strikers as the tie bar is moved from an unlocked position to a locked position. The movement of the first and second bent sections along the first and second ramp respectively as the tie bat moves towards the locked position results in the sash and frame being pulled together.

Improved casement windows are also disclosed. One disclosed casement window comprises a window sash pivotally connected to a window frame. A tie bar is slidably secured to the window frame. The tie bar is coupled to a lock handle that is also coupled to the window frame. The tie bar comprises a first bent section disposed between straight sections and a second bent section disposed between straight sections. All of the straight sections are linearly aligned with one another and at least some of the straight sections of the tie bar are slidably mounted to the window frame. The improved window further comprises first and second strikers mounted to the window sash. The first striker comprises a first ramp that receives a first bent section and the second striker comprises a second ramp that receives a second bent section when the tie bar is slidably moved towards the first and second strikers as the tie bat is moved from an unlocked position to a locked position. The movement of the first and second bent sections along the first and second ramp respectively as the tie bat moves towards the locked position results in the sash and frame being pulled together All of the above lock configurations can be applied to other pivoting closures such as doors.

In a refinement, the position of strikers may be adjustable with respect to the tie bar after installation. Such adjustable strikers include strikers with ramp members connected to base members. The position of the ramp members may be adjusted with respect to the base members using a ratchet mechanism, slotted fastener attachment mechanisms and the like. In another refinement, the adjustable strikers may comprise an eccentric roller disposed on the ramp. The eccentrically mounted rollers may be rotated to adjust their positions with respect to the tie bar after installation.

It will be noted that lock mechanisms suitable for both wood and final windows are disclosed.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiment illustrated in greater detail on the accompanying drawings, wherein:

FIG. 4 is a partial perspective view of the tie bar disclosed in FIGS. 1-3;

FIG. 5 is an end view of the tie bar shown in FIG. 4;

FIG. 6 is a partial perspective view of another tie bat disclosed herein;

FIG. 12 is a perspective view of an adjustable striker disclosed herein;

FIG. 13 is an end view of the striker of FIG. 12;

FIG. 14 is a perspective view of yet another adjustable striker disclosed herein;

FIG. 15 is a partial sectional view of a window frame and sash illustrating an engagement between a disclosed tie bar and the striker of FIGS. 12-13;

FIGS. 22-23 illustrate engagement between the tie bar and yet another striker equipped with a roller that may be eccentric or of a conventional type;

FIGS. 24-25 illustrate engagement between the disclosed tie bar and yet another striker equipped with a different roller that may be eccentric or of a conventional type;

FIG. 27 is a perspective view of yet another adjustable striker;

FIG. 28 is a partial sectional perspective view of the adjustable striker shown in FIG. 27.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
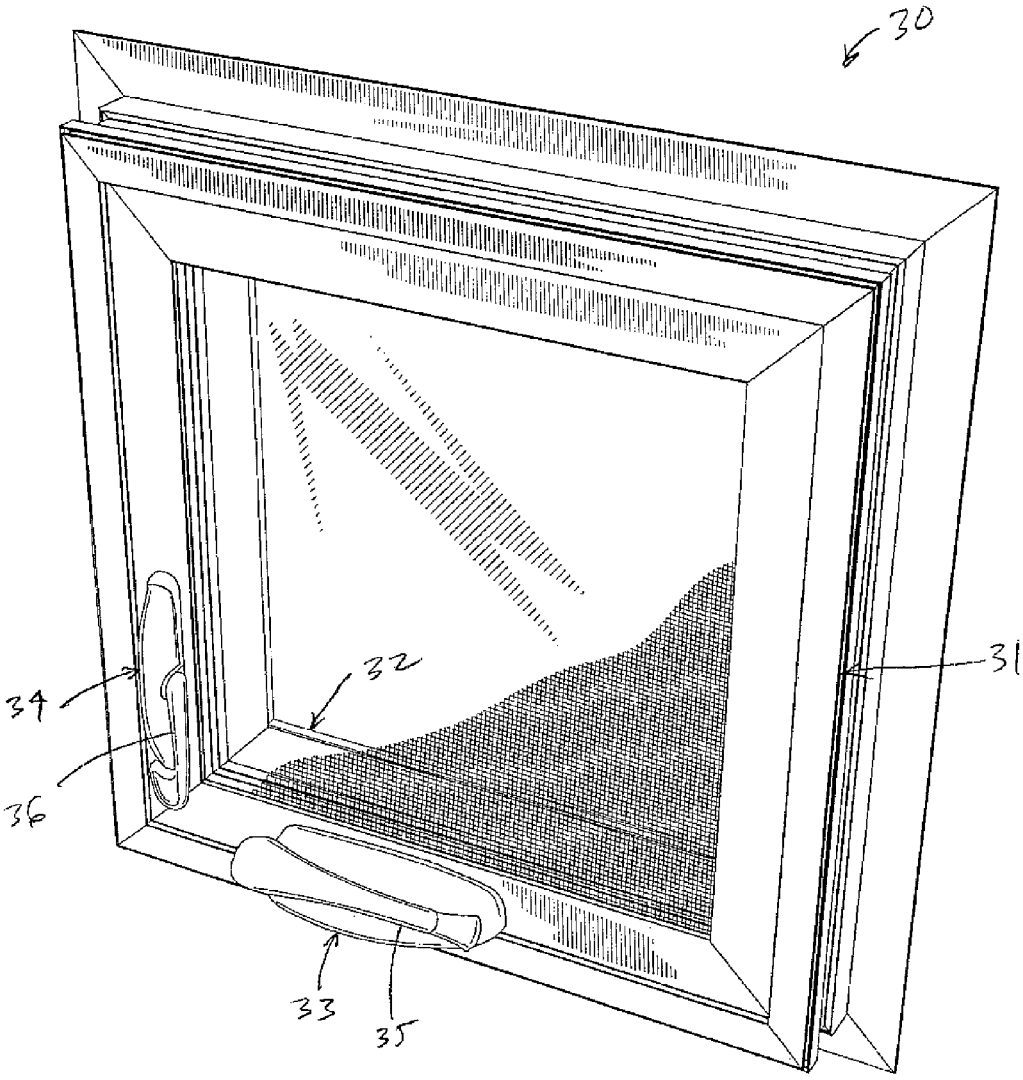
FIG. 1 is a perspective view of a casement window that can employ the locking hardware disclosed herein.

Turning first to FIG. 1, a casement window 30 is shown that is of the type for which the disclosed locking systems are intended. The window 30 includes a stationary window frame 31 and a pivoting window sash 32. Also shown in FIG. 1 is a crank operator 33 and a lock actuator 34. Both the crank operator 33 and lock actuator 34 include handles 35, 36 respectively. The window 30 of FIG. 1 is a vinyl window, although the lock systems are disclosed herein can be used on either vinyl or wood windows Turning to FIG. 2A, a partial view of the window 30 is shown with the window 30 in a closed position. The lock actuator 34 comprises a fork 37 that is coupled to a tie bar 38. The fork 37 is also coupled to the handle 36, the details of which are not shown and not important to the present application, which is directed toward the tie bar 38, striker 39 and variations thereof. While the coupling mechanism between the lock actuator 34 and the tie bar 38 is shown as a fork 37, other coupling mechanisms will be apparent to those skilled in the art and are considered within the spirit and scope of this disclosure.

Turning to FIG. 14, the ramp member 42*c* of the striker 39*c* includes its own base plate 72 which frictionally engages the base plate 41*c* by way of a plurality of transverse ridges 73 and corresponding grooves 74. Of course, other means for frictionally engaging one plate 72 with another plate 41*c* will be apparent to those skilled in the art. The fasteners (not shown) that pass through the slotted openings 75 in the plate 72 and through the openings 176 in the plate 41*c* hold the plates 72, 41*c* together once the correct position of the ramp member 42*c* is determined.

Figure 2A:
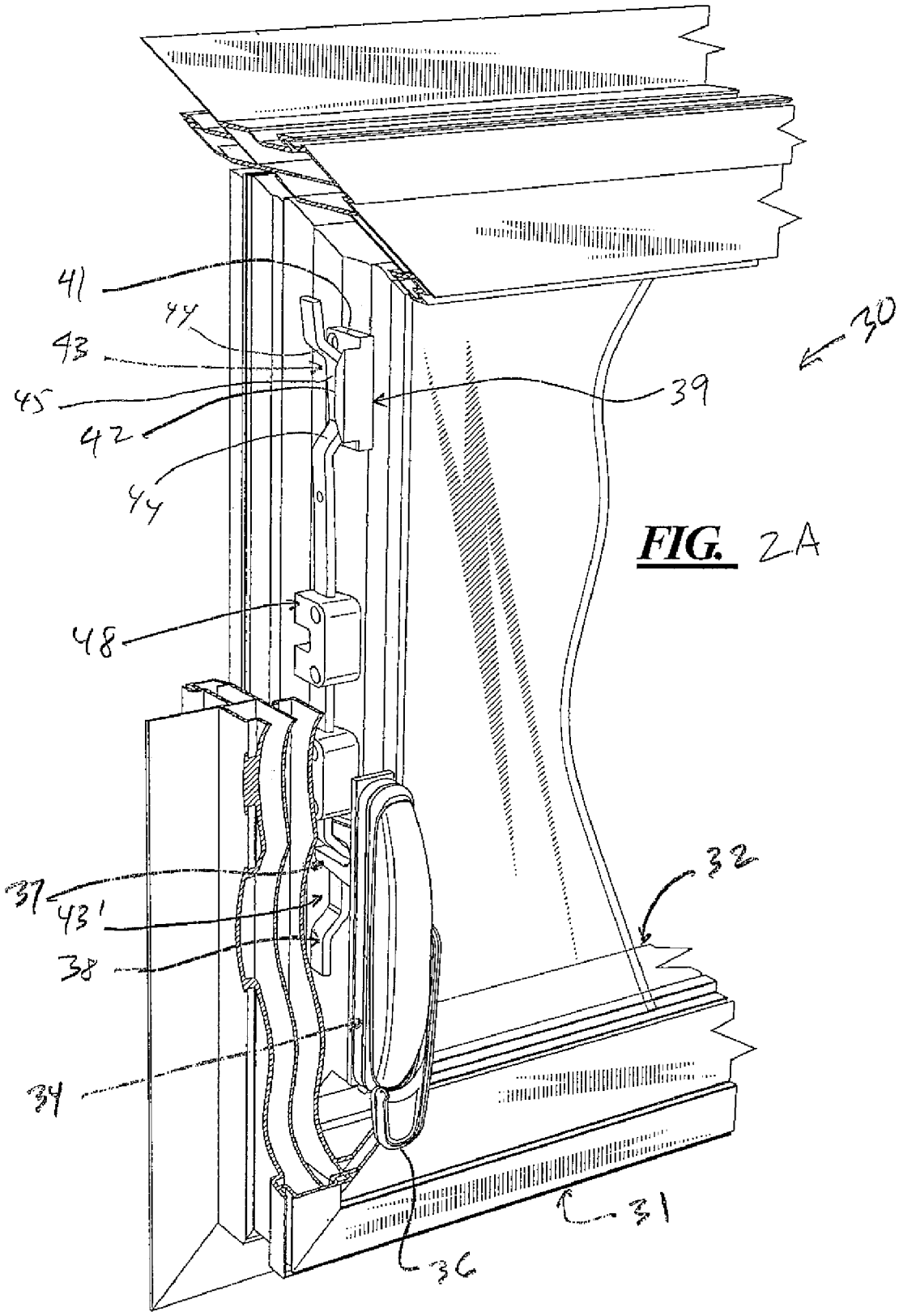
FIG. 2A is a partial perspective view of the window of FIG. 1 with part of the sash removed thereby exposing the lock operator connection to the disclosed tie bar and engagement of the disclosed tie bar with a non-adjustable striker.
Figure 2B:
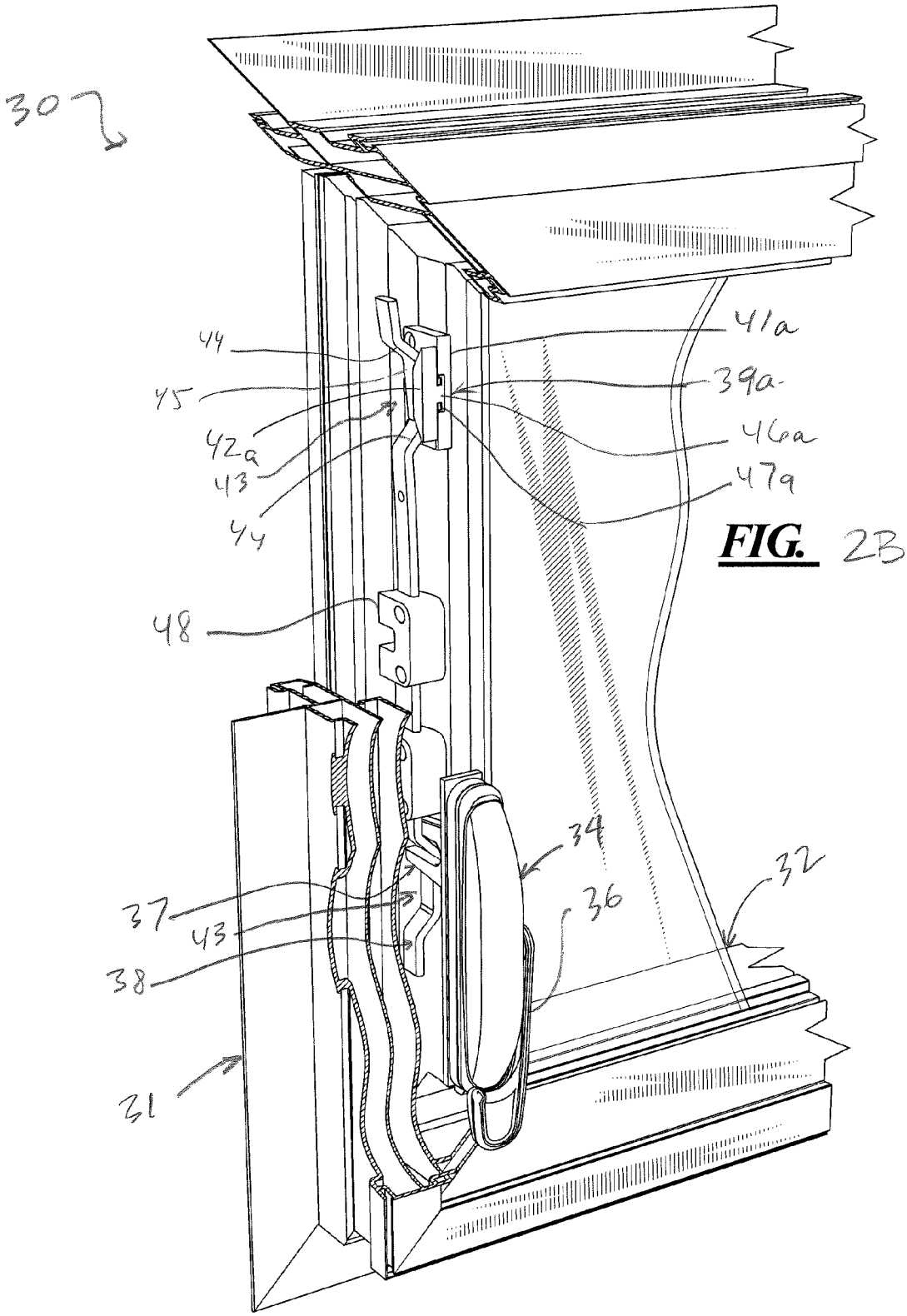
FIG. 2B is another partial perspective view of the window of FIG. 1 and identical to that of FIG. 2A but showing and engagement of a disclosed tie bar with an adjustable striker.

Also shown in FIG. 2A is a non-adjustable striker 39. As will be described in greater detail below, the striker 39 includes a base 41 and the ramp 42. The tamp 42 engages the bent section 43 of the tie bar 38. In the embodiment shown in FIG. 2A, the bent section 43 has a trapezoidal shape with end walls 44 connected to a middle section 45. As the middle section 45 engages the ramp 42 of the striker 39, the sash 32 and frame 31 are pulled together. In the embodiment shown in FIG. 2A, an additional bent section 43, is included for purposes of coupling the tie bar 38 to the lock actuator 34 via the fork member or coupling member 37. FIG. 2B shows an identical arrangement except for the striker 39*a* which is adjustable. As will be discussed in greater detail below, the positional relationship between the ramp member 42*a* and the base member 41*a* is adjustable as the ramp member 42*a* is not fast with or integrally connected to the base member 41*a* but, instead, is connected to the base member 41*a* with a tongue 46*a* and groove 47*a* combination that will be described in greater detail below connection with the related striker 39*b* illustrated in FIG. 12. Also shown in FIGS. 2A and 2B is a guide member 48 secured to the window frame 31 that allows us lighting movement of the tie bar 38 with respect to the window frame 31.

Figure 3:
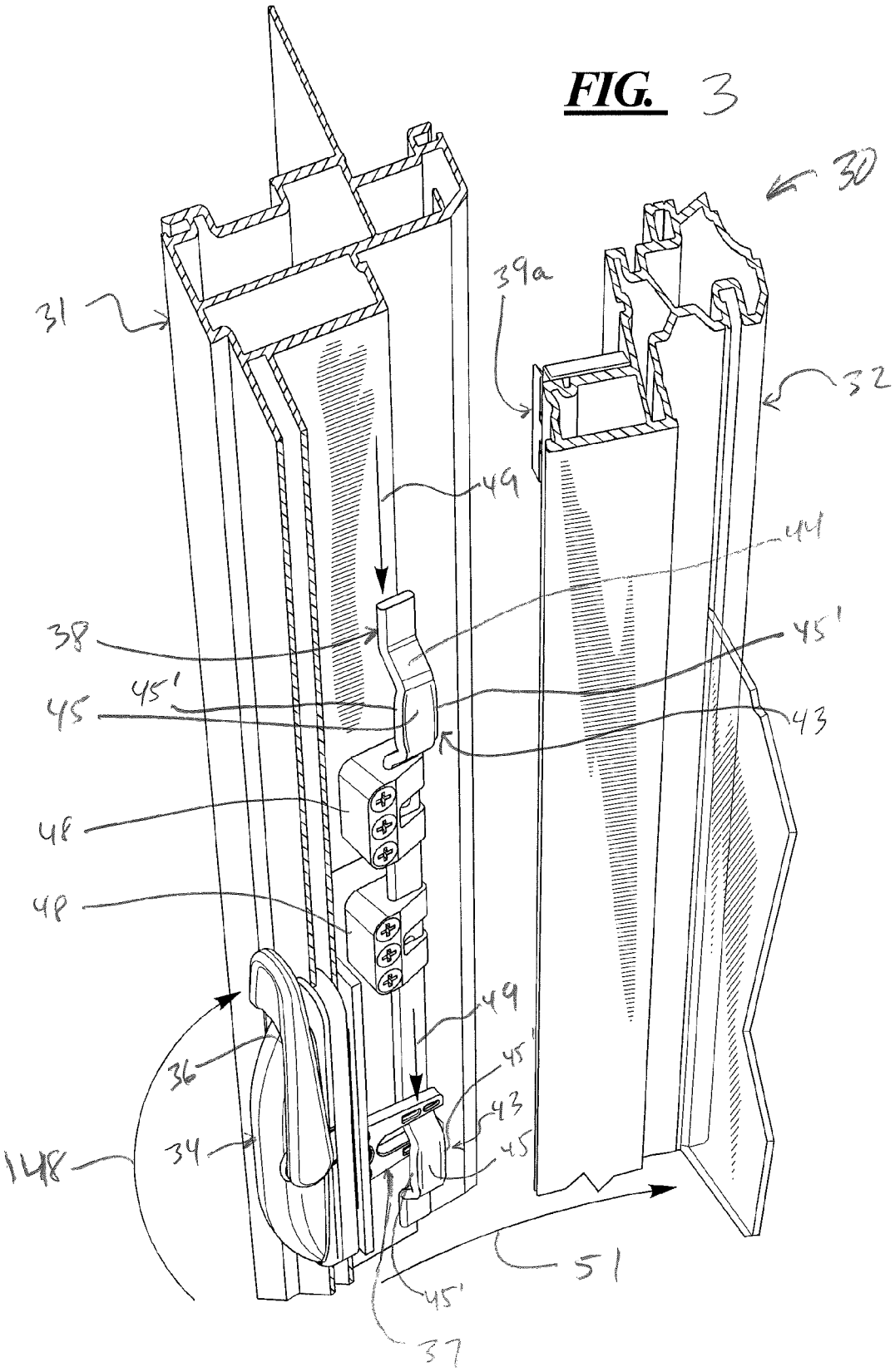
FIG. 3 is a partial perspective view of a sash in an open position with respect to a window frame, also shown in a partial perspective view, and with the lock operator and tie bar, mounted to the pivoting sash, and in an open or unlocked position.

Turning to FIG. 3, a pair of guide members 48 are shown. Other designs for the guide members 48 will be apparent to those skilled in the art. The tie bar 38 is shown in greater detail in that the middle section 45 includes flanged or broadened outer edges 45' to facilitate engagement between the bent section 43 and the ramp member 42*a* of the striker 39*a*, which is only partially shown in FIG. 3. The broadened outer edges 45' keeps the tie bar 38 engaged with the striker 39*a* when external loading causes the sash 32 to twist. To move the lock actuator 34 and tie bar 38 to the open position, the handle 36 is moved upward in the direction of the arrow 148 which causes the tie bar 38 to move downward in the direction of the arrows 49. With the lock actuator 34 and tie bar 38 in the open position, the crank operator 33 can be utilized to crank the window sash 32 outward or open in the direction of the arrow 51.

Figures 7, 10, 11:
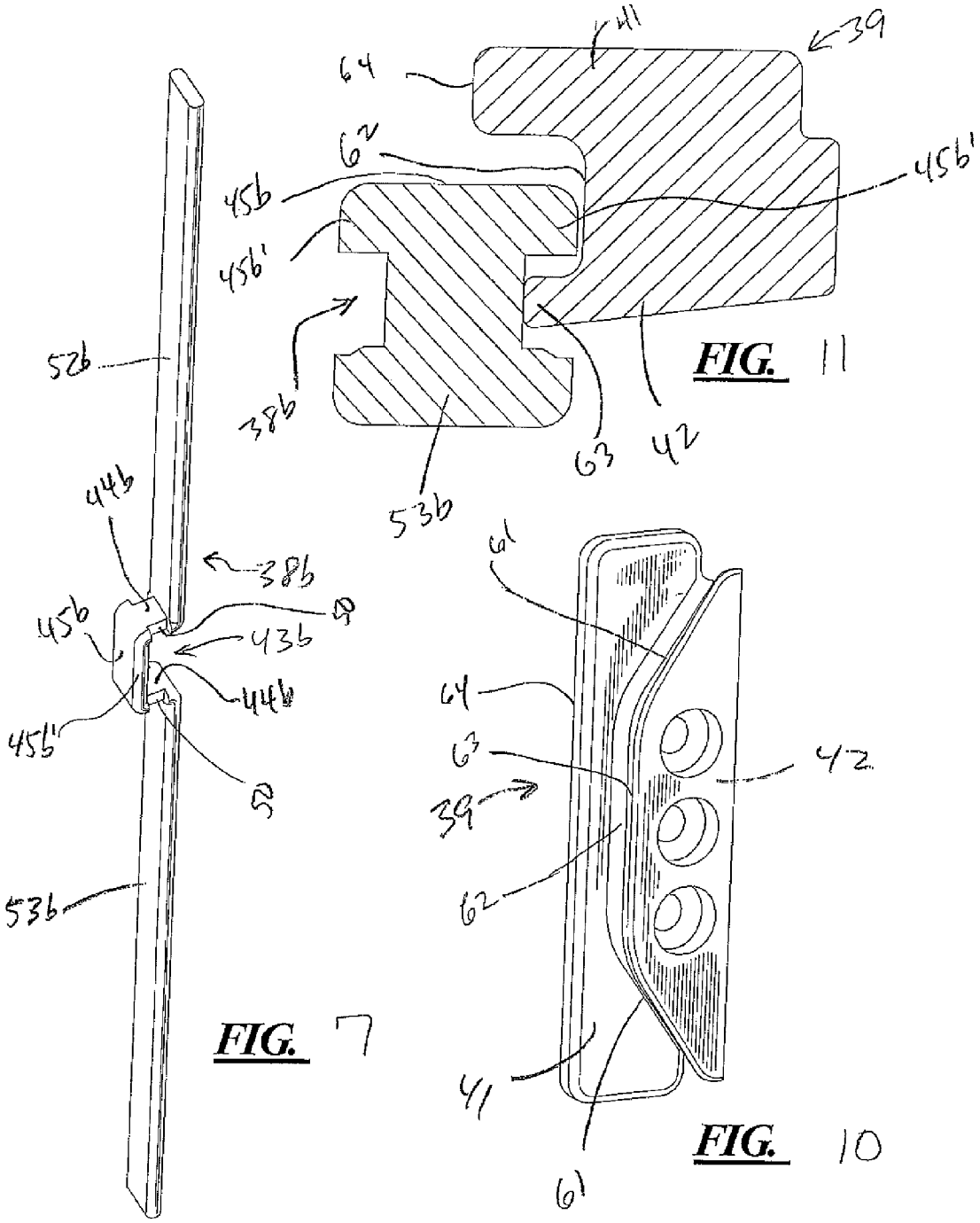
FIG. 7 is a partial perspective view of yet another tie bar disclosed herein.
FIG. 10 is a perspective view of a non-adjustable striker that can be used with the tie bats disclosed herein.
FIG. 11 is a sectional view of an engagement between the striker of FIG. 10 and the tie bar of FIG. 7.

The tie bar 38 is illustrated in greater detail in FIGS. 4-5 and two additional tie bar configurations are illustrated in FIGS. 6-7. In FIGS. 4-5, the tie bar 38 of FIGS. 2A-3 is shown in greater detail. The bent section 43 is disposed between two straight sections 52, 53. The bent section 43 includes ramped walls or end walls 44 that sandwich a middle section 45 that is relatively flat. In one preferred embodiment, the middle section 45 is stamped to provide the flared or flanged sides 45' that facilitates the engagement between the middle section 45 and the ramp 42 of the striker 39.

In FIG. 6, the tie bar 38*a* includes a bent section 43*a* sandwiched between straight sections 52*a*, 53*a*. However, the bent section 43*a* includes upright end walls 44*a* that connect the straight sections 52*a*, 53*a* to a flat middle section 45*a* thereby providing the bent section 43*a* with a rectangular shape as shown in FIG. 6. FIG. 7 illustrates a variation of the tie bar 38*a* of FIG. 6 in that the bent section 43*b* of tie bar 38*b* of FIG. 7 is rectangular-shaped but includes a middle section 45*b* with stamped or flanged outer edges 45*b*' and narrow end walls 44*b* disposed between straight sections 52*b*, 53*b*. The recesses 50 act to permit entry of a lip 63 of a ramp section 42 of the striker 39 to thereby hold the relationship between the striker 39 and the tie bar 38*b* in the event external stress forces cause the sash 32 to twist or warp thereby causing the striker 39 to twist out of its original alignment with respect to the tie bar 38*b*.

Figure 8:
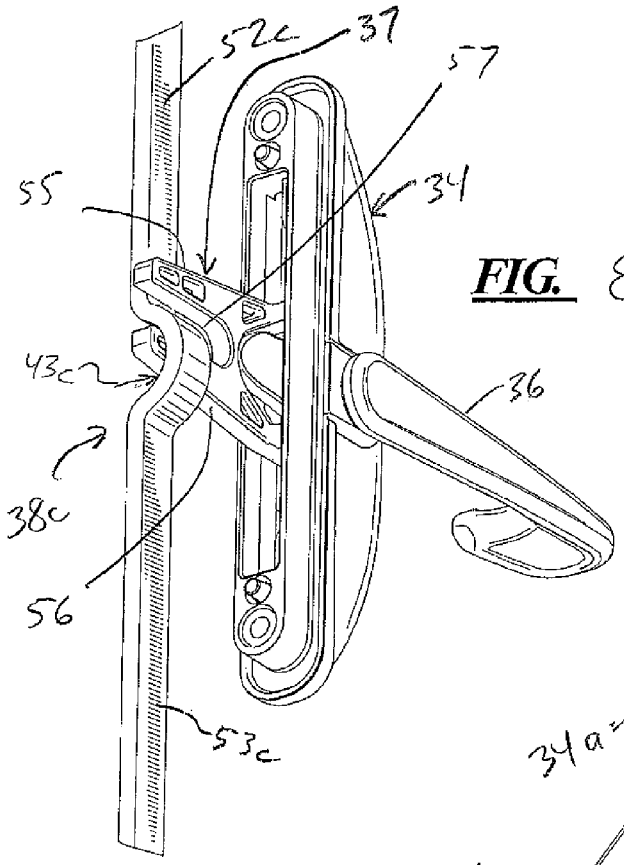
FIG. 8 is a bottom perspective view of a lock operator designed for use on vinyl windows and engaging yet another tie bat disclosed herein.
Figure 9:
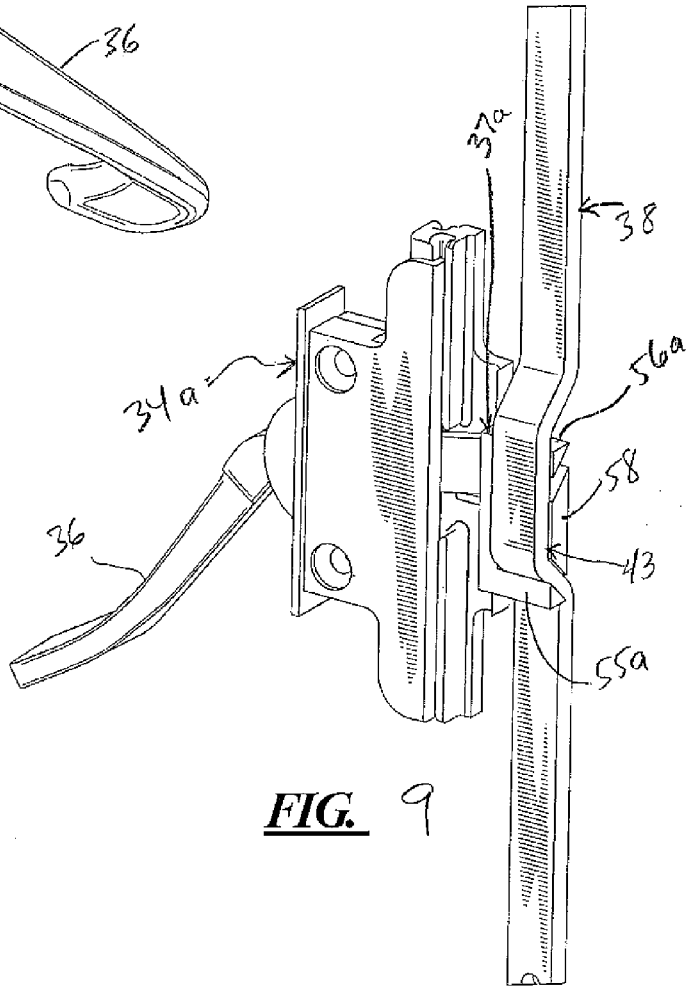
FIG. 9 is a bottom perspective view of a lock operator designed for use on wood windows and engaging still another tie bar disclosed herein.
Figure 16:
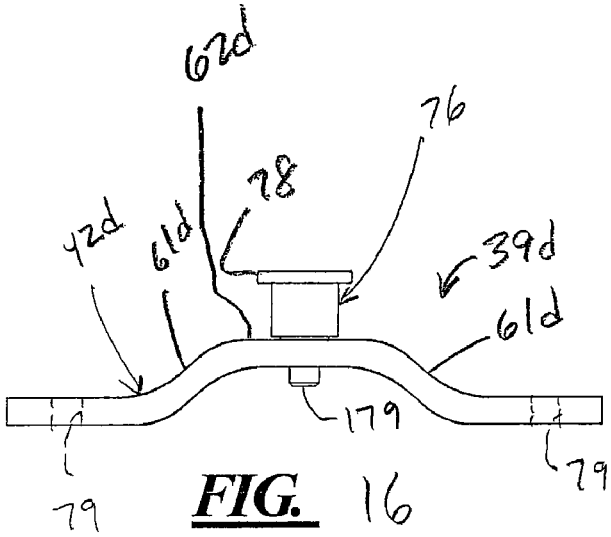
FIG. 16 is a partial side plan view of a disclosed striker connected to a roller, which can be of either a non-eccentric or eccentric type as illustrated in FIGS. 17-20.
Figure 17:
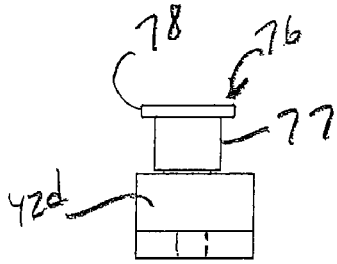
FIG. 17 is an end view of a non-eccentric roller connected to the striker of FIG. 16.

An additional tie bar 38*c* is illustrated in FIG. 8 which includes a curved bent section 43*c* disposed between straight sections 52*c*, 53*c*. The curved bent section 43*c* can be easily coupled to a fork or coupling member 37 of the lock actuator 34 as shown in FIG. 8. A wood operator 34*a* is illustrated in FIG. 9 which is coupled to the tie bar 38 illustrated previously in FIGS. 2A and 2B Comparing the operators 34, 34*a* of FIGS. 8 and 9, the fork 37 of the operator 34 includes a pair of legs 55, 56 is separated by a channel 57 through which the curved bent section 43*c* extends. Similarly, the operator 34*a* includes a pair of fork legs 55*a*, 56*a* through which the bent portion 43 of the tie bar 38 extends. An additional which 58 is connected to the fork member 37*a* to increase the stability of the connection between the tie bar 38 and the operator 34*a*

FIG. 10 is a perspective view of a non-adjustable striker 39. The ramp section 42 is fixedly connected to the base section 41. The ramp 42 includes inclined surfaces 61 with a flat middle surface 62 disposed therebetween. As seen in FIG. 11, the flat upper section 62 is connected to an upwardly protruding lip 63 that guides the middle section 45*b* of the tie bar 38*b* into the slot disposed between the lip 63 and the upper edge 64 of the base member 41. Movement of the middle section 45*b* along the ramped surface 61 and onto the upper flat surface 63 of the striker 39 results in an engagement between the middle section 45*b* of the tie bar 38*b* and the lip 63 of the striker 39 which, in turn, results in a pulling of the striker 39 towards the window frame 31 and therefore a pulling of the window sash 32 towards the window frame 31. As is known in the art, the use of sequentially engaging strikers and rollers can result in a sequential zipping of the window sash 32 shut. Similarly, the use appropriately spaced bent sections 43 and strikers 39 can result in the same sequential locking or zipping action of the window sash 32.

FIGS. 12-14 illustrate two additional adjustable strikers 39*b*, 39*c*. Referring first to the striker 39*b* of FIGS. 12-13, the ramp member 42*b* includes a tongue 46*b* with a plurality of transverse slots 66 that received outwardly protruding teeth 67 of an adjustment knob 68. As seen in FIG. 12, the adjustment knob 68 includes a shaped aperture 69 that receives a tool or bit (not shown) for rotating the knob 68 and adjusting the relative position of the ramp member 42*b* with respect to a tie bar (not shown in FIG. 12). Adjusting the position of the ramp member 42*b* will affect the ease or difficulty in moving the lock operator handle 36 to a locked position thereby causing the bent portion 43 of the tie bar 38 to traverse one inclined portion 61*b* and the flat portion 62*b* of the ramp member 42*b* to close the window 30. A side view of the striker 39*b* and lip 63*b* is shown in FIG. 13. Rotation of the knob 68 moves the ramp member 42*b* upward or downward is indicated by the arrow 70.

Turning to FIG. 14, the ramp member 42c of the striker 39c includes its own base plate 72 which frictionally engages the base plate 41c by way of a plurality of transverse ridges 73 and corresponding grooves 74. Of course, other means for frictionally engaging one plate 72 with another plate 41c will be apparent to those skilled in the art. The fasteners (not shown) that pass through the slotted openings 75 in the plate 72 and through the openings 176 in the plate 41*c* hold the plates 72, 41*c* together once the correct position of the ramp member 42*c* is determined.

Turning to FIG. 15, the striker 39*b* is illustrated in engagement with a bent section 43 of a tie bar 38. As shown by the position of the tie bar 38 and solid line, the edge 45' of the flat portion 45 appears to be free of engagement with the flat portion 62*b* of the striker 39*b*. Thus, it would appear that adjustment of the ramp member 42*b* in the direction of the arrow 75 is warranted.

Figure 18:
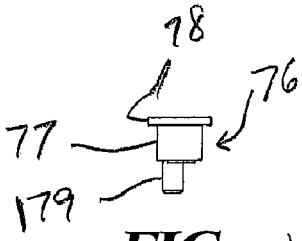
FIG. 18 is a plan view of an eccentric roller.
Figure 19:
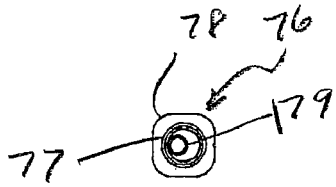
FIG. 19 is a bottom plan view of the eccentric roller of the FIG. 18.
Figure 20:
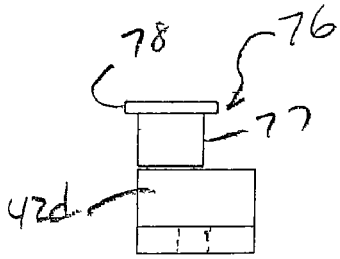
FIG. 20 is an end view of the eccentric roller of FIGS. 18-19 mounted on the striker of FIG. 16.

FIGS. 16-20 illustrated alternative strikers 39*d*. The striker 39d comprises a body 42d made from bar stock and bent in a manner similar to the bent sections 43 of the tie bars 38. A roller 76 is mounted to the striker body 42*d* which includes ramped portions 61d disposed on either side of a flat middle portion 62*d*. The ramp body 42*d* may include one or more apertures 79 for fastening the striker 39*d* two a sash 32. The roller 76 may be of the eccentric type shown in FIGS. 18 and 19 with a roller body 77, an outer lip 78 and a fastening post 179. In FIG. 18, the post 179 is eccentrically mounted to the roller body 77. Thus, rotation of the roller structure 76 after installation of the roller 76 on the striker body 42*d* will adjust the position of the roller 77 on the striker body 42*d* as illustrated by comparing FIGS. 17 and 20. Because it is often desirable to rotate the roller 76 after installation on the ramp body 42*d*, one preferred method of attaching the roller 76 to the ramp body 42*d* is riveting.

Figure 21:
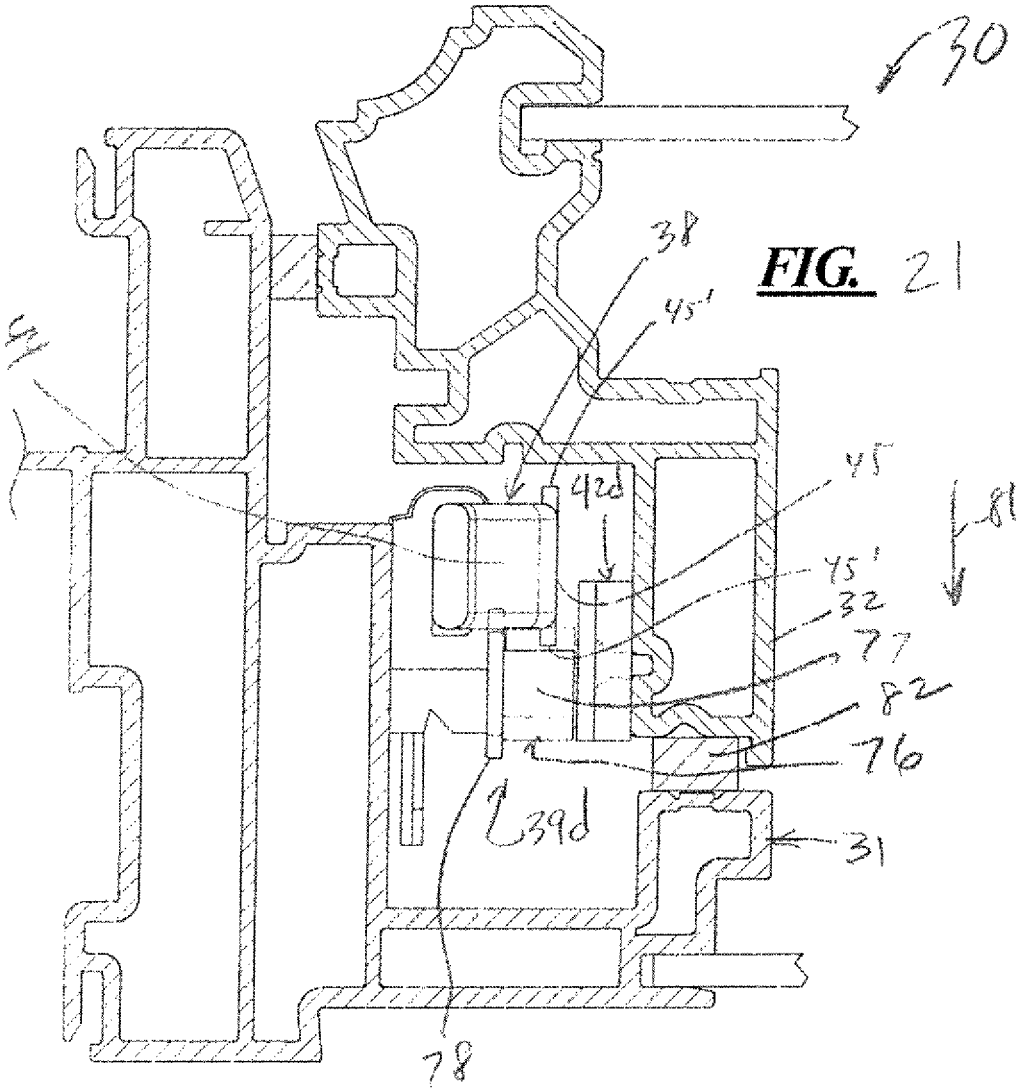
FIG. 21 is a partial sectional view of a window frame and sash illustrating an engagement between a striker/roller combination of FIGS. 16-20 and the tie bar of FIGS. 4-5.

FIG. 21 illustrates a striker 39*d* mounted to a sash 32 and equipped a roller 76 eccentrically mounted to a ramp body 42*d*. The flanged portion 45' of the flat portion 45 of the tie bar 38 has engaged the roller body 77 and pulled the sash 32 in the direction of the arrow 81 to compress the seal 82 disposed between the sash body 32 and frame body 31.

FIGS. 22-25 illustrate alternative striker designs 39*e* and 39*f*. Referring first to FIGS. 22-23, the striker 39*e* includes a ramp member 42*e* connected to a roller 76*e*. Engagement of the roller 76*e* with the bent portion 43 of the tie bar 38 results in the striker 39*e* and sash to which it is connected being pulled in the direction of the arrow 83 (FIG. 23). Similarly engagement of the smaller roller 76*f* of the striker 39*f* by the bent portion 43 of the tie bar 38 results in the striker 39*f* being pulled in the direction of the arrow 84 (FIG. 25).

Figure 26:
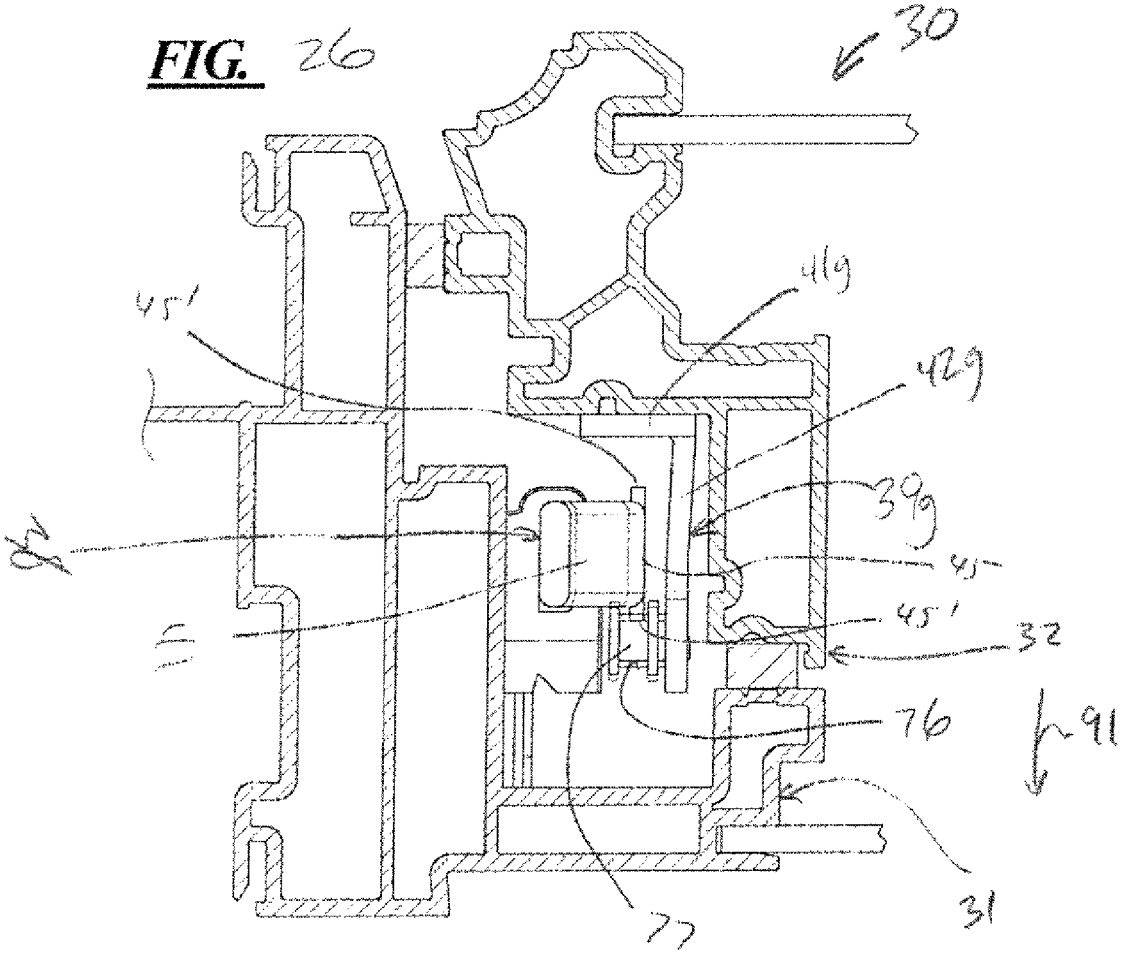
FIG. 26 is a sectional view of a window frame equipped with the tie bar of FIGS. 4-5 and a sash equipped with a striker of the type illustrated in FIGS. 22-25.
Figure 29:
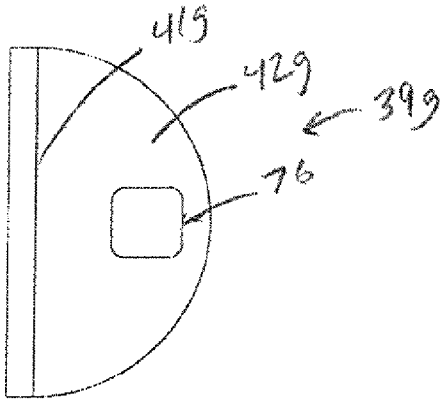
FIG. 29 is a plan view of the striker shown in FIG. 26.

Turning to FIG. 26, yet another striker design 39*g* is disclosed which includes a base 41*g* connected to an upright member 42*g* which, in turn, is connected to an adjustable roller 76 (see also FIG. 29). The flanged portion 45' of the flat portion 45 of the tie bar 38 has engaged the roller body 77 and has pulled the sash 32 in the direction of the arrow 91 to compress the seal 82 disposed between the sash body 32 and frame body 31.

Finally, FIGS. 27 and 28 disclose yet another adjustable striker 39*h* with the base 41*h* and ramp member 42*h* which includes a cavity 95 that accommodates a roller 77*h* mounted eccentrically on a shaft 79*h*. The roller 77*h* protrudes through the opening in the flat portion 62*h* of the ramp 42*h*. The access opening 96 in the ramp 42*h* enables the shaped opening 97 of the roller 77*h* to be accessed with a tool, such as an Allen wrench. Thus, the eccentrically mounted roller 77*h* can be rotated so that it protrudes above the flat portion or pads 62*h* thereby adjusting the effective position of the striker 39*h* without actually moving the striker 39*h* on the sash.

By providing the tie bars as shown generally at 38 with bent sections 43 as opposed to rollers attached to the tie bars, the disclosed tie bars avoid the need for riveting a roller onto the tie bar. The tie bar can be bent and stamped in one easy process. Thus, instead of riveting the pins of the rollers to the tie bar, the riveting process is foregone for the much faster bending and stamping process or simple bending process. Further, if it is desired to enlarge the flat portion 45, the stamping of the flat portion to increase its width to include the outer flanges 45 is faster and much easier than any riveting process. By eliminating the riveting process, time is saved as well as additional parts because rollers may be eliminated. Further, the disclosed tie bars can be easily incorporated into existing lock operators as shown. The tie bars can be used on doors and windows. The number of bends for bent portions can vary from one to eight or more. The lock operator can be connected to the tie bar in any convenient fashion as will be apparent to those skilled in the art. A variety of adjustable striker designs is also disclosed.

Various types of bends may be utilized although only trapezoidal, rectangular and semicircular or curved are shown. Additional geometries include oval and triangular. Any bend geometry that can mimic the height of a roller may be appropriate.

While only certain embodiments have been set forth, alternatives and modifications will be apparent from the above description to those skilled in the art. These and other alternatives are considered equivalents and within the split and scope of this disclosure and the appended claims.

What is claimed:

1. A lock assembly for securing a pivoting closure panel and a stationary frame together, the lock assembly comprising:

a tie bar coupled to a lock handle, the tie bar comprising a bent section disposed between linearly aligned and coplanar straight sections, the straight sections being slidably mounted to one of the panel or frame, the bent section comprises two opposing end walls connected to and extending obtusely from the straight sections disposed on either side of the bent section, the opposing end walls extending toward each other and toward a flat middle section that connects the end walls and the flat middle section being disposed parallel to the straight sections, the flat middle section includes outwardly extending edges that create a width that is greater than the width of the straight sections of the tie bar such that the edges will keep the tie bar engaged with a striker when external loading causes a twisting of the closure panel, and the striker being mounted to the other of the panel or frame, the striker comprising a ramp that receives the bent section and when the tie bar is slidably moved towards the striker as the tie bar is moved from an unlocked position to a locked position, the movement of the bent section along the ramp as the tie bar moves towards the locked position results in the panel and frame being pulled together.

2. The lock assembly of claim 1 wherein a position of the ramp section of the striker relative to the bent section of the tie bar is adjustable.

3. A lock assembly for securing a panel to a frame, the lock assembly comprising:

a tie bar coupled to a lock handle, the tie bar comprising a bent section disposed between linearly aligned and coplanar straight sections, at least some of the straight sections of the tie bar being slidably mounted to the frame, the lock handle being mounted to the frame, the bent section comprises two opposing end walls connected to and extending obtusely from the straight sections disposed on either side of the bent section, the opposing end walls extending toward each other and toward a flat middle section that connects the end walls and the flat middle section being disposed parallel to but spaced apart from the straight sections, the flat middle section includes outwardly extending edges that create a width that is greater than the width of the straight sections of the tie bar such that the edges will keep the tie bar engaged with a striker when external loading causes a twisting of the closure panel, and the striker being mounted to the panel, the striker comprising a ramp that receives the bent section when the tie bar is slidably moved towards the striker as the tie bar is moved from an unlocked position to a locked position, the movement of the bent section along the as the tie bar moves towards the locked position which results in the panel and frame being pulled together.

4. The lock assembly of claim 3 wherein a positioning of the ramp the striker is adjustable relative to the tie bar.

5. A casement window comprising:

a window sash pivotally connected to a window frame, a tie bar slidably secured to the frame, the tie bar coupled to a lock handle that is also coupled to the frame, the tie bar comprising a bent section disposed between linearly aligned and coplanar straight sections, at least some of the straight sections of the tie bar being slidably mounted to the frame, the bent section comprises two opposing end walls connected to and extending obtusely from the straight sections disposed on either side of the bent section, the opposing end walls extending toward each other and toward a flat middle section that connects the end walls and the flat middle section being disposed parallel to the straight sections, the flat middle section includes outwardly extending edges that create a width that is greater than the width of the straight sections of the tie bar such that the edges will keep the tie bar engaged with a striker when external loading causes the sash to twist, the striker being mounted to the sash, the striker comprising a ramp that receives the bent section when the tie bar is slidably moved towards the striker as the tie bar is moved from an unlocked position to a locked position, the movement of the bent section along the ramp as the tie bar moves towards the locked position results in the sash and frame being pulled together.

6. The window of claim 5 wherein a positioning of the ramp the striker is adjustable relative to the tie bar.

* * * * *